United States Patent [19]

Armbruster et al.

[11] Patent Number: 4,713,294

[45] Date of Patent: Dec. 15, 1987

[54] FOUNDRY SHELL CORE AND MOLD COMPOSITION

[75] Inventors: David R. Armbruster, Forest Park; Calvin K. Johnson, Lockport, both of Ill.

[73] Assignee: Acme Resin Corporation, Westchester, Ill.

[21] Appl. No.: 866,438

[22] Filed: May 23, 1986

[51] Int. Cl.[4] ..... B05D 7/00; B44D 1/20; B32B 5/16; C08G 8/04

[52] U.S. Cl. ..... 428/404; 106/38.25; 427/134; 427/221; 428/407; 528/157

[58] Field of Search ..... 427/134, 221; 428/404, 428/407; 106/38.24, 38.25, 38.7; 528/157

[56] References Cited

U.S. PATENT DOCUMENTS

| | | | |
|---|---|---|---|
| Re. 25,661 | 10/1964 | Less et al. | 427/221 |
| 4,290,928 | 9/1981 | Funabiki et al. | 427/221 X |
| 4,345,003 | 8/1982 | Matsushima et al. | 427/221 X |
| 4,403,076 | 9/1983 | McDonald | 427/221 X |

*Primary Examiner*—Michael R. Lusignan

[57] ABSTRACT

A foundry shell core and mold composition comprises particulate matter coated with a curable phenolic-furan resin. The process for making the resin coated particulate matter substantially eliminates the sue of hexamethylene tetramine.

18 Claims, No Drawings

FOUNDRY SHELL CORE AND MOLD COMPOSITION

BACKGROUND OF THE INVENTION

1. Field of the Invention

The present invention relates to a foundry shell and mold composition used to form sand cores and molds for metal casting.

2. Description of the Prior Art

Phenolic novolak resins have been used for many years as a sand binder with hexamethylene tetramine as a crosslinking-curing agent to form sand cores and molds for metal casting. This is accomplished by coating sand with a mixture of phenolic novolak resin and hexamethylene tetramine to produce a free flowing product consisting of individually coated grains of the sand.

Coating the sand has been typically accomplished by at least two different methods. In the first method, the resin can be coated onto the sand particles from a solvent solution of methanol or other suitable solvent. The solvent is then evaporated as the resin and sand are mixed at temperatures ranging from ambient to somewhat above ambient. This process is known as "warm coating", and the hexamethylene tetramine is added to the resin in the form of a powder, in a mixer before the solvent has evaporated.

In the second method, solid resin can be added to hot sand, wherein it is mixed, melted and coated on the grains of sand. An aqueous solution of hexamethylene tetramine is then added to the hot resin-sand mixture. The water evaporates and cools the sand to a point where the resin solidifies, and forms a free flowing mixture of coated sand grains. This coating process is known as "hot coating" and is the most widely accepted commercial coating process used in the United States.

The resin coated sand produced by either the warm coated process or the hot coating process is then placed on a hot pattern or in a hot core box to melt the resin and bond the sand grains together while the hexamethylene tetramine acts as a curing agent to cure the resin into a durable thermoset product.

The sand molds and cores formed by this process are often in the shape of a bonded sand shell that is the negative of the mold or core shape, hence the name "shell process" for this molding method and "shell sand" for the resin coated sand.

The shell process is widely used in the foundry industry, despite having several drawbacks which limit its application. These drawbacks stem from the use of hexamethylene tetramine as the curing agent. During the reaction of hexamethylene tetramine with the resin, nitrogen is released from the hexamethylene tetramine in the form of objectionable ammonia fumes. The nitrogen that remains in the cured resins can result in nitrogen caused casting-gas defects in some types of iron and steel castings.

Accordingly, it would be very desirable to have a shell sand binder that is substantially nitrogen free, or which has a tolerable nitrogen content. Obviously, a requirement of this type would either eliminate the use of hexamethylene tetramine as a curing agent, or restrict its use to very low levels. Typically, 12 to 18 weight % of hexamethylene tetramine is currently used based upon the total weight of the phenolic resin solids. Since hexamethylene tetramine is 40% nitrogen by weight, the hexamethylene tetramine contributes substantially to the nitrogen level of the binder.

Methods of circumventing the use of hexamethylene tetramine have been suggested. For example, paraformaldehyde has been used in place of hexamethylene tetramine to eliminate the nitrogen in the cured resin. However, the use of paraformaldehyde produces formaldehyde fumes instead of ammonia fumes when the resin is cured. Moreover, paraformaldehyde cure rates are slow, resulting in decreased productivity.

It is also conceivable to use a solid thermosetting resole resin to replace some or all of the novolak resin, and thus reduce or eliminate the amount of hexamethylene tetramine used. However, resole containing coated sands tend to cake in storage, and the resins tend to age, resulting in loss of properties with time. Retaining some novolak resin would necessitate the continued use of hexamethylene tetramine, resulting in the continued presence of nitrogen, although to a lesser extent.

An article by Albanese, J. "Shell Mixing Processes and Equipment", Transactions of the American Foundrymens' Society, pages 225–228, vol. 68 (1960), covers the use of novolak resin and hexamethylene tetramine in various types of shell coating processes. Another article by Less, F. W. "Sand Coating by the Hot Process—The Method and Materials", The British Foundryman, pages 468–470, (December 1968) deals with the development of hot methods for sand coating, including preheated sand and flaked resins, and preheated sand with water borne resins, using hexamethylene tetramine as an accelerator. Johnson, C. K., "Advances in Shell and Hotbox Processes Offer Many Advantages", Modern Casting, pages 25–27 (April 1984), details state of the art improvements in both shell and hotbox technology. For example, in shell technology the availability of special sand formulations, faster curing resins, faster buildup resins, peel resistant flakes and fast shakeout sand have benefited the industry.

British Patent Specification No. 1,179,284 seeks to avoid the disadvantages of hexamethylene tetramine, which causes porosity in castings, and discloses a resin composition for use in coating a sand, comprising a resole resin and a novolac resin. The resole is prepared by reacting a phenol and an aldehyde under alcoholic alkaline conditions with a molar excess of aldehyde with regard to the phenol. The proportion of resole in the resin composition varies from about 20 to 50% by weight of the total composition.

British Patent Specification No. 1,563,686 discloses a process for coating sand with a phenol-formaldehyde resin for use in shell molds and cores. The process involves reacting phenol and formaldehyde at an elevated temperature to produce a liquid resin having a solidification temperature above about 160° F., and mixing the hot resin with hot sand to coat the sand with the resin, then cooling the coated sand to solidify the resin.

U.S. Pat. No. 3,692,733 to Johnson discloses resin coated sands which are a mixture of about 0.01 to 1.0 part by weight of silicone fluid and 1000 parts by weight of free-flowing sand particles, individually coated with about 1 to 6% by weight of a solid, non-tacky layer of a potentially thermosetting resin comprising an acid catalyzed thermoplastic phenol-formaldehyde resin and curing agent.

U.S. Pat. No. 3,838,095 to Johnson et al discloses that incorporating small amounts of urea compounds into sand coated with a potentially thermosetting phenolformaldehyde novolac resin increases both the buildup rate and cure rate of the resin coated sand.

U.S. Pat. Nos. 4,051,301, 4,134,442 and 4,197,385 all to Laitar, disclose phenolic novolac resins which incorporate a furan resin which can be used in coating foundry sands in connection with hexamethylene tetramine for use in the shell process to produce cores and molds having improved shakeout and collapsability characteristics.

U.S. Pat. No. 4,089,837 to Luttinger et al, discloses the use of resorcinol as an accelerating agent to cure a phenol-formaldehyde resin coated sand composition.

U.S. Pat. No. 4,090;995 to Smillie, discloses a process for preparing a resin coated sand used in shell molds and cores, wherein sand is mixed with phenolformaldehyde resin and at least 3% by weight of salicylic acid, the mixing being carried out at a temperature above the melting point of the resin so that a coating of the resin is formed on the sand, followed by cooling and setting the resin on the sand to solidify the resin coating.

U.S. Pat. No. 4,113,916 to Craig, discloses the incorporation of epoxy and/or phenoxy resins into sand coated with potentially thermosetting phenol-formaldehyde novolak resins improved thermal shock resistant resin coated sands, and do not create smoke and odor problems.

U.S. Pat. No. 4,196,114 to Funabiki et al discloses a process for producing resin coated sand for use in a shell mold. The process includes preheating sand with a lubricant-containing solid resole, which is said to ameliorate a caking problem and allow the resin to be obtained in an early reaction stage with increased methylol content.

U.S. Pat. No. 4,281,090 to Craig discloses that replacing phenol-formaldehyde novolak resin with up to 50% of a catechol-formaldehyde novolak resin in sand coated with a potentially thermosetting novolak resin increases the build-up and cure rate of the resin coated sand, which can then be used to make cores and molds by the shell process.

SUMMARY OF THE INVENTION

The present invention relates to a foundry shell core and mold composition comprising particulate matter coated with a curable phenolic-furan resin. The resin coated particulate matter eliminates the use of novolak-hexamethylene tetramine coated sand particles. A process for preparing the foundry shell core and mold composition is also disclosed.

DESCRIPTION OF THE PREFERRED EMBODIMENTS

In accordance with the present invention, phenolicfuran resins can be used to coat foundry shell sand with a curable layer of the resin. The curable coated foundry shell sand can be used in place of the novolak-hexamethylene tetramine coated shell sand and thereby substantially completely eliminate the use of the undesirable hexamethylene tetramine.

The foundry shell sand of the present invention can bond and cure when contacted with a heated pattern in the same manner as conventional novolak-hexamethylene tetramine shell sands, to form shell molds and cores with good strength properties at the high temperatures encountered in the casting of iron and its alloys.

Silica sand is the most common particulate material used to make foundry shell molds or cores. However, other types of sand can also be used such as lake sand, bank sand, zircon sand, chromite sand and olivine sand. Other equivalent particulate matter can also be used provided the melting or decomposition temperature of this material is higher than the temperature of the liquid metal used for casting. Many materials of this type are refractories. The sand particles are preferably of a relatively uniform size and generally vary from about 20 to 270 mesh, U.S. Standard Screen size.

The phenolic resins used in the practice of this invention are thermosetting resins made from phenol or substituted phenols and formaldehyde or other aldehydes. The preferred substituted phenols are where either the two ortho, one ortho and the para, or the two ortho and the para positions are unsubstituted. In general, the phenols that can be used are those which are suitable for making phenolic resins. Phenol and formaldehyde are preferred materials. Many of the phenolic resins suitable for use are called "resoles" and can be either in a liquid or solid state.

A "resole" is the resin product of the partial condensation of a phenol with an aldehyde in such proportions that the partial condensate is capable of further condensation to an infusible or thermoset condition.

A "novolac" is the resin product of the substantially complete condensation of a phenol with an aldehyde in such proportions that condensation is not capable of proceeding to form an infusible product. The present invention also contemplates the use of resole/novolac resin combinations which are thermosetting.

The furan resins used in the practice of this invention are thermosetting resins made by reacting furfuryl alcohol with aldehydes such as formaldehyde, or by the self-polymerization of furfuryl alcohol, or a combination of reacting furfuryl alcohol with aldehydes such as formaldehyde and self-polymerization.

Furfural can also be used in place of furfuryl alcohol. A terpolymer of phenol, furfuryl alcohol and formaldehyde can also be used in place of phenolic and furan resins.

The preferred curable resin used to coat the foundry sand is a curable furfuryl alcohol-phenolformaldehyde resin, especially that disclosed in copending patent application Ser. No. 866,439, filed May 23, 1986, entitled "Phenol-Formaldehyde-Furfuryl Alcohol Resins", the disclosure of which is incorporated by reference herein.

Accordingly, liquid phenol-formaldehyde-furfuryl alcohol resin is mixed with the foundry sand at a temperature of about 250° to 450° F. until the resin partially cures to a state where it would solidify at room temperature. The amount of time required to accomplish this depends on the sand temperature. Higher sand temperatures could shorten the time. A "working" length of time is needed to coat the liquid resin on the sand and cure it to the point where it would be a solid at room temperature. Depending on the mixing equipment, this time can range from about 30 seconds to about 3 minutes or longer.

Water is then added to cool the mix and solidify the resin. The amount of resin can vary from about 1 to 8% by weight of the foundry sand. The amount of water is determined empirically. As general rule sufficient water is added to cool the resin-foundry sand mix to about 140° to 180° F. When the mix is cooled to this temperature range in the mixer, it can break down to become a free-flowing product or it may be discharged from the mixer before it is free flowing as long as subsequent handling and cooling operations produce a free-flowing product. The important concern is that at ambient temperature the coated foundry sand be a free-flowing product composed of individual particles coated with a solid thermosetting resin.

Although it is possible to practice this invention without the use of a catalyst, it is preferred to use a curing catalyst which is sufficiently non-volatile at the operating temperatures, to accelerate the cure of the resin.

The curing catalyst can be incorporated into or premixed with the resin or added to the mixer after the resin has been added and coated on the foundry sand particles. The preferred method is to add the catalyst to the mixer after the resin has been coated. As mixing is continued, the resin cures on the particulate matter to produce a free flowing product comprised of individual particles coated with the cured resin. The advantage of the catalyst is that its use can result in a lower coating temperature and/or faster processing time.

The catalyst can be used as is or dissolved in water or other suitable solvent system depending on the catalyst. A strong acid catalyst must be diluted with water to prevent localized reaction of the catalyst with the resin before the catalyst has had a chance to mix with the resin. Solid catalysts that do not melt below the mixing temperature are preferably used in aqueous solution.

Specific catalysts include acids with a pKa of about 4.0 or lower, such as phosphoric, sulfuric, nitric, benzenesulfonic, toluenesulfonic, xylenesulfonic, sulfamic, oxalic, salicylic acid, and the like; water soluble multivalent metal ion salts such as the nitrates and chlorides, of metals including Zn, Pb, Ca, Cu, Sn, Al, Fe, Mn, Cd, Mg and Co; and ammonia or amine salts of acids with a pKa of about 4.0 or lower, wherein the salts include the nitrates, chlorides, sulfates, fluorides, and the like.

The preferred class of catalyst is the ammonium salts of acids and the preferred catalyst is aqueous ammonium nitrate.

The amount of catalyst used can vary widely depending on the type of catalyst used, type of resin used, mixing temperature and type of mixer. In general, the amount of catalyst solids can range from about 0.2% to 10% by weight of the resin.

It is also desirable to include a silane additive to ensure good bonding between the resin and the particulate matter. The use of organofunctional silanes as coupling agents to improve interfacial organic-inorganic adhesion is especially preferred. These organofunctional silanes are characterized by the following formula:

$$R^1—Si—(OR)_3$$

where $R^1$ represents a reactive organic function and OR represents a readily labile akoxy group such as $OCH_3$ or $OC_2H_5$. Particularly useful for coupling phenolic or furan resins to silica are the amino functional silanes of which Union Carbide A1100 (gamma aminopropyltriethoxy) is an example. The silane can be premixed with the resin or added to the mixer.

It is also desirable but not necessary to incorporate a lubricant into the sand mix. The addition of a lubricant to the resin-coated sand can make it more free flowing. This results in denser cores and molds with increased strength and resistance to metal penetration as compared to similar shell sand without a lubricant.

Calcium stearate or ethylene bis-stearamide have been found to be especially useful as lubricants. These lubricants can be incorporated into the resin or added at any point during the coating process, in amounts of about 0.03 to 1.0% by weight of the particulate material.

It is also useful to employ salicylic acid as a cure accelerator. Typically, the salicylic acid is incorporated into the resin, but it can also be added during the coating process. The salicylic acid can range from about 0.5% to 8% by weight of the resin.

Other additives commonly used in the shell process can be incorporated to modify casting results. These include Vinsol® (Hercules Inc., a complex mixture of compounds derived from southern pine wood), iron oxide, clay, potassium fluoroborate, epoxy resin, saw dust and the like.

Although a primary objective of this invention is to substantially completely eliminate the use of hexamethylene tetramine, it is conceivable that for certain applications, it would be advantageous to utilize small amounts of hexamethylene tetramine. Thus, the rapid curing characteristics of the hexamethylene tetramine can justify its inclusion at substantially lower concentration levels for certain casting procedures, depending upon the mechanics of the operation, core structure and configurations. The amounts of hexamethylene tetramine utilized would be quite small and not exceed 6% by weight of the resin solids.

The examples which follow serve to illustrate the present invention, and all parts and percentages are by weight unless otherwise indicated, and all screen mesh sizes are U.S. Standard Screen sizes.

EXAMPLE 1

Phenolic Shell Sand Control—Hot Coating Method

Into a 3 quart mixing bowl was placed one kg of Wedron 730 sand (Wedron Silica Co., Wedron, Ill.) which is typical of round grain silica sands used for foundry sand molds and cores. The sand was heated with a gas flame to 270° F. 31 grams of Acme 1145 flake novolak phenolic shell resin containing ethylene bis-stearamide dissolved therein was added and mixed with a Hobart C-100 mixer for 90 seconds to melt the resin and coat the sand. At this time 15 milliliters of quench liquid (28% water solution of hexamethylene tetramine) was added. At 260 seconds of mixing time the sand temperature was 180° F. At this time the coated sand was removed from the bowl and consisted of free flowing individual sand grains coated with a curable binder.

EXAMPLE 2

Hot Coating of Phenolic-Furan Resin (a) Resin Preparation

Into a 5 liter three necked flask equipped with a stirrer, themometer and reflux condenser were charged 1200 grams of phenol, 1200 grams of 50% formalin and 60 grams of 25% zinc acetate solution in water. The flask was then heated and the batch reacted for 4 hours at 97° to 100° C. At this time the batch was cooled with cooling water and a sample checked for formaldehyde content and found to be 6.45%. The batch was then vacuum dehydrated at about 50° C. to remove 549 grams of distillate. 800 grams of furfuryl alcohol was then added to the flask and the reaction continued for 3 hours and 16 minutes at 90° to 100° C. The batch was then cooled to give a product with the following properties:

| | |
|---|---|
| Viscosity | 1,231 cps at 25° C. |

-continued

| | |
|---|---|
| Unreacted Formaldehyde | 1.8% |
| Unreacted Phenol | 8.6% |
| Unreacted Furfuryl Alcohol | 7.8% |

(b) Hot Coating Procedure

The equipment of Example 1 was used to heat one kilogram of Wedron 730 sand to 375° F. 44 grams of resin from (a) was added and mixed for 15 seconds. At this time 1.5 grams of Acrawax® C. beads (ethylene-bis-stearamide, Glyco, Inc., Greenwich, CT) were added as a lubricant. At 30 seconds of total mixing time 0.4 grams of a 50% solution of $NH_4NO_3$ in water was added as a cure accelerator. At 89 seconds of total mixing time 45 milliliters of quench water was added. At 260 seconds of total mixing time the sand temperature was 155° F. The sand was removed from the bowl and consisted of individual sand grains coated with a curable phenolic-furan resin.

EXAMPLE 3

Hot Coating Method

The equipment of Example 1 was used to heat 1 kilogram of Wedron 730 sand to 375° F. 44 grams of Example 2(a) resin was added and mixed for 15 seconds at which time 0.9 grams of salicylic acid was added. At 35 seconds of mixing time 0.4 grams of a 30% $CuCl_2$ solution in water was added as a cure accelerator. At 125 seconds 35 milliliters of water was added to the mix followed by 1.2 grams of powdered calcium stearate. At 260 seconds of mixing time the mix temperature was 160° F. and consisted of free flowing individual sand grains coated with a curable phenolic-furan resin.

In Table I, which follows, the phenolic furan coated sands of Examples 2 and 3 were compared with the phenolic shell sand control of Example 1. Tensile strengths were run on all three sands by making ¼ inch cured shell "dog bone" specimens with a Dietert No. 363 (Harry W. Dietert Co., Detroit, Mich.) heated shell curing accessory.

The specimens were cured at 450° F. for 3 minutes. After cooling, the specimens were broken with a Dietert 400 Universal sand test machine to determine tensile strength. Three dog bones were broken for each coated sand and the average reported. Each of the phenolic furan coated shell sands of Examples 2 and 3 had excellent cold tensile strength properties which demonstrates their ability to bond and cure to form high strength shell molds or cores.

A portion of each shell sand was used to prepare cores for use in the AFS Hot Distortion Test. See "Mold & Core Test Handbook", Section 7, page 17, First Edition, 1978, American Foundrymen's Society, Inc., Des Plaines, Ill. 60016. In this test, a section of bonded sand, 1×¼×4½ inches, is loaded as a cantilever and heated to about 1400° F. in the center of one face while a deflection sensor rests on the free end of the test core. The length of time until the test core collapses is the hot distortion time. This test is indicative of how well a shell core or mold will hold up to hot metal. Both phenolic-furan coated shell sands had very good distortion times that were in the same range as the control Example 1. Loss on ignition (L.O.I.) tests were also run on sections of bonded sands. The L.O.I.'s expressed as weight percent lost provide the total residual amount of binders on the sand (resin plus additives).

TABLE I

| SHELL SAND | TENSILE STRENGTH | HOT DISTORTION | L.O.I. |
|---|---|---|---|
| Example 1 | 420 psi | 186 seconds | 3.36 |
| Example 2 | 318 psi | 202 seconds | 3.04 |
| Example 3 | 305 psi | 156 seconds | 3.06% |

What is claimed is:

1. A process for preparing a foundry shell core and mold composition composed of particulate matter having a coating of a curable phenolic-furan resin with substantially no hexamethylene tetramine, comprising:

(a) contacting particulate material with an uncured phenolic-furan resin at a temperature of about 250° to 450° F. to form a resin-particulate matter mixture, said phenolic-furan resin having a mole ratio of phenol to furfuryl alcohol of from about 0.1:1 to about 10:1;

(b) maintaining said temperature until the resin partially cures to a state where it would solidify at ambient temperatures;

(c) contacting the partially cured resin coated particulate material with a sufficient amount of cooling water under continued mixing until the partially cured resin solidifies;

(d) continuing mixing until the partially cured resin coated particulate material breaks up to form a free flowing product that is thermoplastic and thermosetting, comprising individual particles coated with solidified partially cured resin.

2. The process of claim 1, wherein said resin is a mixture of a phenolic resin and a furan resin.

3. The process of claim 1, wherein said resin is phenol-formaldehyde-furfuryl alcohol.

4. The process of claim 1, wherein the resin-particulate material mixture prior to step (b) is contacted with small amounts of catalyst selected from the group consisting of acids with a pKa of about 4.0 or lower, water soluble multivalent metal ion salts, and ammonia or amine salts of acids with a pKa of about 4.0 or lower.

5. The process of claim 4, wherein said catalyst comprises ammonia or amine salts of acids with a pKa of about 4.0 or lower.

6. The process of claim 5, wherein the salts are selected from the group consisting of nitrates, chlorides, sulfates and fluorides.

7. The process of claim 4, wherein the multivalent metal ions are selected from the group consisting of Zn, Pb, Ca, Cu, Sn, Al, Fe, Mn, Cd, Mg and Co.

8. The process of claim 5, wherein said catalyst is aqueous ammonium nitrate.

9. The process of claim 5, wherein a silane additive is included in or before step (a).

10. The process of claim 5, wherein said silane has the formula:

$$R^1\text{—Si—}(OR)_3$$

wherein $R^1$ has a reactive organic function and OR is an alkoxy group.

11. The process of claim 1, wherein a lubricant is included.

12. The process of claim 11, wherein said lubricant is selected from the group consisting of calcium stearate and ethylene bis-stearamide.

13. The process of claim 12, wherein calcium stearate is the lubricant, and is used in combination with salicylic acid.

14. The process of claim 1, wherein the particulate matter is selected from the group consisting of silica, lake sand, bank sand, olivine sand, chromite sand, zircon sand and mixtures thereof.

15. The process of claim 1, wherein up to 6% by weight of hexamethylene tetramine, based on the total weight of resin solids is added at step (c).

16. Foundry shell core and mold compositions formed by the process of claim 1.

17. Foundry shell sand compositions formed by the process of claim 1.

18. A free flowing foundry shell sand core and mold composition consisting essentially of particulate matter coated with a curable phenolicfuran resin, containing substantially no hexamethylene tetramine, said phenolicfuran resin having a mole ratio of phenol to furfuryl alcohol of from about 0.1:1 to about 10:1.

* * * * *